United States Patent [19]

Grossmann et al.

[11] Patent Number: 4,539,128

[45] Date of Patent: Sep. 3, 1985

[54] WATER-SOLUBLE LUBRICANT

[75] Inventors: Max Grossmann, Frankfurt am Main; Rainer Helwerth, Eschborn, both of Fed. Rep. of Germany

[73] Assignee: Hoechst Aktiengesellschaft, Fed. Rep. of Germany

[21] Appl. No.: 399,711

[22] Filed: Jul. 19, 1982

[30] Foreign Application Priority Data

Jul. 24, 1981 [DE] Fed. Rep. of Germany ..... 3129244

[51] Int. Cl.[3] ..... C10M 1/20; C10M 1/26

[52] U.S. Cl. ..... 252/49.3; 252/52 A; 252/56 R

[58] Field of Search ..... 252/49.3, 52 A, 56 R

[56] References Cited

U.S. PATENT DOCUMENTS 4,250,047 2/1981 Katabe et al. ..... 252/52 A

*Primary Examiner*—Jacqueline V. Howard

*Attorney, Agent, or Firm*—Connolly and Hutz

[57] ABSTRACT

Water-soluble lubricant characterized by a content of compounds of the formula 1

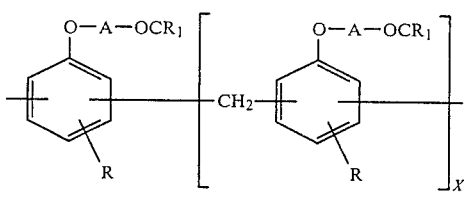

(1)

wherein R is hydrogen, $C_1$–$C_{12}$alkyl or $C_1$–$C_{12}$alkenyl, $R_1$ is $C_1$–$C_{18}$ alkyl or $C_2$–$C_{18}$alkenyl, A is a group of the formulae $$-(CH_2CH_2O)_m- \text{ and } (C_3H_6O)_n-,$$

X is an integer of from 0 to 15 and the numerals for m and n are chosen such that the total content of ethylene oxide and/or propylene oxide in the molecule amounts to 10–800 alkylene oxide units.

4 Claims, No Drawings

WATER-SOLUBLE LUBRICANT

Oils or aqueous emulsions of mineral oils or fatty oils containing anionic or nonionic emulsifiers or blends of such emulsifiers are used generally in forming and cutting metal working operations. To improve the properties of these oil-base emulsions more or less great quantities of substances improving their lubricity, in most cases chlorine-, phosphorus- or sulfur-containing compounds, may be contained therein. However, these oil-base emulsions frequently do not comply with the requirements imposed on metal working compositions.

Emulsions, which are multi-phase systems, often have an unsatifactory physical stability and frequently tend to separate into an oil phase and a water phase, as a result of an increase of particles under operating conditions. Thus, the emulsion is no longer suitable for said application purpose and it does no longer possess the optimal properties of such metal working fluids.

There was, consequently, a need of metal working fluids which on the one hand should be distinguished by a satisfactory lubricating effect and which on the other hand should have a satisfactory stability.

Recent developments profit therefore from the fact that aqueous single-phase systems, for example clear solutions of lubricating, water-miscible polymeric substances based on ethylene oxide and propylene oxide, do not undergo such disadvantageous alterations and that they have therefore frequently far longer life in practice.

It is known that water-soluble representatives of the class of substances of polyalkylene oxides, for example straight chain or branched ethylene-propylene copolymers are used for said purpose (cf. Th. Mang et al. in "Kontakt und Studium 1980", vol. 61, page 35; Edition Expert).

Practice has proved, however, that the lubricating effect of this class of substances is too low to perform also rather severe high-speed operations in the field of cutting working of ferrous and nonferrous metals such as milling or drilling or threading.

It is therefore the object of the present invention to provide water-soluble lubricants suitable for application in high-speed working operations such as punching, threading, tapping and the like and which are appropriate for working operations not only of ferrous metals such as steel and steel alloys, but also of nonferrous metals such as copper, aluminum, brass, bronze and the like.

Subject of the present invention are water-soluble lubricants containing one or several compounds of the formula

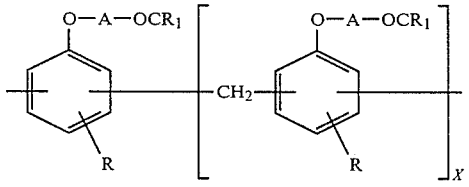

wherein R is hydrogen, $C_1$–$C_{12}$alkyl or $C_1$–$C_{12}$alkenyl, $R_1$ is $C_1$–$C_{18}$alkyl or $C_2$–$C_{18}$alkenyl, A is a group of the formulae $$-(CH_2CH_2O)_m \text{ and } -(C_3H_6O)_n-,$$

X is an integer of from 0 to 15 and the numerals for m and n are chosen such that the total content of ethylene oxide and/or propylene oxide in the molecule amounts to 10 to 800 alkylene oxide units.

Preference is given to compounds of the above formula wherein R is hydrogen or $C_1$–$C_4$alkyl, $R_1$ is $C_6$–$C_{18}$alkyl or $C_6$–$C_{18}$alkenyl, A is a group of the formula $-(CH_2CH_2O)_m-$, X is an integer of from 1 to 9 and m is chosen such that the total content of ethylene oxide in the molecule amounts to 40 to 200 units of ethylene oxide.

The above-described compounds are prepared according to known processes. These processes comprise the following steps: Phenol or alkylphenols or mixtures thereof with formaldehyde or paraformaldehyde are condensed to give linear of cyclic novolaks (cf. Hultzsch, Chemie der Phenolharze, 1950, page 114 or U.S. Pat. No. 4,032,514 or J. Org. Chem. vol. 43, No. 25, 1978, 4905–4906). The novolaks obtained are reacted in known manner with alkylene oxides to yield oxethylation products of novolaks, which latter are converted to carboxylic acid esters. Phenol or alkylphenols having straight chain or branched alkyl radicals with from 1 to 12 carbon atoms and being bifunctional with respect to formaldehyde or blends thereof may be used for the manufacture of the linear or cyclic novolaks. The reaction water formed during the formation of the novolaks has to be removed. This may be done by azeotropic distillation, during the reaction with aldehydes or after the reaction with aldehydes or by applying a vacuum. Suitable catalysts to be used are, for example, acids such as hydrochloric acid, sulfuric acid, p-toluenesulfonic acid, oxalic acid, and examples of suitable preferred alkaline catalysts comprise sodium hydroxide, potassium hydroxide, sodium methylate or potassium-tert.butylate.

The novolaks obtained are either open chain or cyclic products. In the open chain novolaks both free valencies in the above formulae are saturated by hydrogen atoms, whereas both free valencies in the case of the cyclic novolaks form together a cycle. The linear novolaks are brittle to soft resins and the cyclic novolaks are white to yellowish solids melting at a temperature above 300° C. Both types of novolaks are blends of multichain phenols or alkylphenols linked via methylene bridges.

Oxethylation of the linear novolaks is conducted according to known processes using alkylene oxides in the presence of alkaline catalysts at a temperature of from about 100° to 210° C., preferably of from 140° to 180° C. Suitable alkaline catalysts are in particular alkali metal hydroxides such as potassium hydroxide or preferably sodium hydroxide or alkali metal alcoholates such as sodium methylate or potassium-tert.butylate. The concentration of these alkaline catalysts should be preferably from 0.05 to 1.0 weight %, referred to the novolak. Oxethylation may be conducted under normal pressure or in autoclaves, while adding the alkylene oxide in gaseous or liquid state. The quantity of alkylene oxide is chosen such that from 10 to 50 alkylene oxide radicals on the average per phenolic hydroxy group are introduced. Oxalkylation of the high-melting cyclic novolaks may be carried out according to U.S. Pat. No. 4,032,514, Example 13C, in a xylene suspension. Upon complete oxalkylation, the xylene may remain in the oxalkylation product as water entrainer during the esterification step.

The novolak oxalkylation products are esterified according to known methods using carboxylic acids in the absence or in the presence of azeotropic entrainers or carboxylic acid derivatives such as carboxylic acid halides, carboxylic acid anhydrides or by transesterification using $C_1$–$C_4$alkyl esters of carboxylic acids. Suitable carboxylic acids are in particular saturated monocarboxylic acids having from 2 to 20, in particular from 6 to 18, carbon atoms or mixtures thereof. Examples hereof are: so-called short-chained fatty acids, 2-ethylhexanoic acid, i-nonanoic acid, dodecanoic acid, i-tridecanoic acid, stearic acid, i-stearic acid or oleic acid.

Part of these carboxylic acids may be replaced by carboxylic acids having from 2 to 5 carbon atoms, for example by acetic acid.

The properties of the above-described compounds, in particular their water-solubility and their foaming behavior are influenced by the length of the radicals R and $R_1$, by the value for X and by the degree of oxalkylation, expressed by the indices m and n. It can be stated generally that the water-solubility decreases with increasing length of the radicals R and $R_1$ and with decreasing degree of oxalkylation. The desired solubility in water can be reached in any case by appropriately varying these substituents. The cloud points, measured in a 1% aqueous solution, should be above 25° C., preferably above 30° C.

GENERAL PREPARATION PRESCRIPTION

A number of esterified novolak resins to be used according to the present invention are listed in the following Table A. These compounds are obtained according to the following prescription:

Alkylphenol is placed in a flask together with a catalytically active amount of p-toluenesulfonic acid and the mixture is heated. A 35% formaldehyde solution is slowly dropped in, the quantity of formaldehyde being determined by the respective value for X in the table. Upon fading of the exothermally proceeding reaction, the bath is refluxed for a further 16 hours approximately. Next, the water is distilled off completely at 120°–140° C. under normal pressure and subsequently under reduced pressure. The novolak is obtained upon cooling as brittle colorless resin.

The novolak obtained is placed in an autoclave together with 1.1 g of sodium hydroxide. The air is expelled by nitrogen, whereupon the batch is heated to 150°–170° C. Liquid ethylene oxide or, respectively, a mixture of ethylene oxide and propylene oxide, is introduced at said temperature until the increase in weight in the autoclave has attained the total molar amount indicated in the table in column A. Stirring is continued for one further hour.

A mixture of the oxalkylated novolak, a catalytically active amount of p-toluenesulfonic acid and the quantity of the acid of the formula $R_1$—COOH required in each case is introduced into an agitator vessel provided with a stirrer and a cooler and the batch is heated, while stirring, at a temperature of about 170° C. until no more water is distilled off and until the acid number has dropped to a value below 3. There is obtained an esterification product in the form of a brown substance of oily to wax-like consistence.

TABLE

| | R | X | A | Total molar amount A | $R_1$—CO |
|---|---|---|---|---|---|
| Open-chain compound | | | | | |
| A 1 | $CH_3$ | 5.4 | $C_2H_4O$ | 123.3 | i-Nonanoyl |
| A 2 | p-$CH_3$ | 3.2 | $C_2H_4O$ | 79.2 | " |
| A 3 | $CH_3$ | 6.0 | $C_2H_4O$ | 135.0 | " |
| A 4 | H | 6.7 | $C_2H_4O$ | 101.4 | " |
| A 5 | H/t-$C_4H_9$[1] | 8.3 | $C_2H_4O$ | 211.0 | " |
| A 6 | $C_9H_{19}$ | 7.0 | $C_2H_4O$<br>$C_3H_6O$ | 80.0<br>20.0 | Acetyl |
| A 7 | p-$CH_3$ | 3.8 | $C_2H_4O$ | 100.2 | 2-Ethyl-hexanoyl |
| A 8 | p-$CH_3$ | 3.8 | $C_2H_4O$ | 90–100 | i-Nonanoyl + Acetyl |
| A 9 | H/$C_9H_{19}$[2] | 9.2 | $C_2H_4O$ | 352.9 | i-Nonanoyl |
| A 10 | O—$CH_3$ | 6.5 | $C_2H_4O$ | 230.6 | " |
| A 11 | p-$CH_3$ | 2.9 | $C_2H_4O$ | 72.3 | i-Nonanoyl + Acetyl |
| A 12 | p-$CH_3$ | 4.6 | $C_2H_4O$ | 115.6 | i-Nonanoyl |
| A 13 | p-$CH_3$ | 3.8 | $C_2H_4O$ | 100.7 | " |
| | p-$CH_3$ | 3.8 | $C_2H_4O$ | 104.7 | " |
| A 14 | p-$CH_3$ | 3.3 | $C_2H_4O$ | 79.1 | Acetyl |
| A 15 | p-$CH_3$ | 5.95 | $C_2H_4O$ | 203.5 | i-Tridecanoyl |
| A 16 | p-$CH_3$ | 3.8 | $C_2H_4O$ | 100.2 | Neo-decanoyl |
| A 17 | p-$CH_3$ | 3.8 | $C_2H_4O$ | 99.6 | H |
| Cyclic Compound | | | | | |
| B 1 | p-$CH_3$ | 4.0 | $C_2H_4O$ | 99.3 | i-Nonanoyl |

[1]Mixture of phenol and tert.-butylphenol at a ratio of 1:3
[2]Mixture of phenol and nonylphenol at a ratio of 1:3.

The quantities of esterified oxalkylated novolaks required for the manufacture of the metal working compositions according to the invention may vary within wide limits.

An application concentration of below 10 weight % is generally sufficient for the usual metal working operations. It is an advantage of the metal working compositions according to the present invention that they have a good efficiency at low concentrations. For example, satisfactory efficiency can be reached with a concentration as low as about 0.5 weight % when using the new metal working compositions. The application concentration of the metal working compositions, like that of other known compositions, depends in particular on the nature of the working operation. In usual operations, the application concentration of the new metal working compositions is in a range of from about one to eight weight %. The above-indicated values may be lower or higher, respectively, in particular cases. For example, in particularly severe metal working operations, it may be advisable to use solutions having a content of esterified oxalkylated novolaks up to about 25 weight %.

The water-soluble lubricants may contain further additives such as amines and usual corrosion inhibitors of the series of carboxylic acids and/or condensation products based on a fatty acid and an amine and/or boric acid alkanol amides.

The results of comparative tests listed in the following tables demonstrate that the metal working fluids according to the invention are capable of withstanding extreme load and that they have a distinctly higher loading capacity and resistance to wear than the known preparations. Owing to their very good lubricating and cooling properties the metal working fluids according to the invention are appropriate for high-speed metal working operations such as lathe turning, drilling, grinding, and so on, wherein the lubricant in most cases is subjected to a relatively low load as well as for working operations under severe conditions, for example threading operations, wherein the lubricant is subjected to a heavy load.

The following examples illustrate the invention. Parts and percentages are by weight, unless stated otherwise.

The fretting balance according to Reichert was used to determine the quality of the metal working compositions according to the present invention and to compare said compositions with aqueous solutions of known lubricant components. This device substantially consists of two exchangeable friction parts made from steel of different hardness, one part, a ring wheel, being arranged in movable manner and the second part, a test roll, being arranged in fixed manner. During the test, the ring wheel and the test roll are pressed against each other by applying a defined load via a double lever system while their axes cross each other, the ring wheel immerging partially into the metal working fluid to be examined while performing a rotational movement, thus provoking a constant transport of lubricant to the fretting zone between the test roll and the ring wheel.

As a result of the rotational movement, an elliptic wear mark of more or less great dimension is formed on the test roll, in dependence on the stability of the respective lubricant fluid. A value expressed in $kg/cm^2$ is calculated from said wear zone formed after a defined operating time and from the respective load applied to said friction parts, said value designated as "specific surface pressure" being a measure for the stability of lubricating films (cf. The periodical "Mineral-öl-Technik" 3 (1958), No. 2, pages 1–17).

The tests were carried out using aqueous solutions of esterified oxethylated novolaks having an increasing content of active ingredient or, respectively, of EO/PO block polymers at a concentration of 1.2 and 5 weight %.

The metal working fluids were prepared by dissolving the active ingredients in drinking water of 20° German hardness.

Example 1: Compound A 1 of Table A,
Example 2: Compound A 2 of Table A,
Example 3: Compound A 4 of Table A,
Example 4: Compound A 7 of Table A,
Example 5: Compound A 12 of Table A,
Example 6: Compound B 1 of Table A.

Comparative Product I:

Branched chain EO/PO block polymer, a reaction product of ethylene diamine+30 ethylene oxide units+30 propylene oxide units.

Comparative Product II:

Branched chain EO/PO block polymer, a reaction product of ethylene diamine+30 ethylene oxide units+60 propylene oxide units.

The results of the comparative tests are summarized in the following table.

TABLE B

| Example | Content of active ingredient weight % | Specific surface pressure ($kp/cm^2$) |
|---|---|---|
| 1 | 1 | 320 |
| | 2 | 350 |
| | 5 | 445 |
| 2 | 1 | 300 |
| | 2 | 350 |
| | 5 | 445 |
| 3 | 1 | 330 |
| | 2 | 385 |
| | 5 | 480 |
| 4 | 1 | 310 |
| | 2 | 345 |

TABLE B-continued

| Example | Content of active ingredient weight % | Specific surface pressure ($kp/cm^2$) |
|---|---|---|
| | 5 | 400 |
| 5 | 1 | 310 |
| | 2 | 350 |
| | 5 | 445 |
| 6 | 1 | 270 |
| | 2 | 300 |
| | 5 | 365 |
| Comparison I | 1 | 175 |
| | 2 | 190 |
| | 5 | 210 |
| Comparison II | 1 | 220 |
| | 2 | 240 |
| | 5 | 300 |

The measuring results demonstrate the distinctly superior lubricating properties of the metal working auxiliaries according to the invention. It has proved that the new lubricants according to the invention are capable of withstanding extreme load and that they have a distinctly higher loading capacity and better wear properties than aqueous solutions of known lubricants.

Hence, the lubricants according to the invention are excellently suitable as auxiliary in normal metal working operations such as lathe turning, brilling, grinding and the like, which generally involve a comparatively low load of the lubricant and they can moreover be used advantageously in very severe working operations such as threading.

What is claimed is:

1. Water-soluble lubricants characterized by a content of compounds of the formula (1)

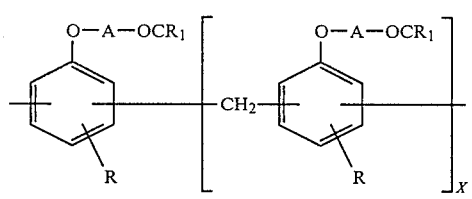

(1)

wherein R is selected from the group consisting of hydrogen, $C_1$–$C_{12}$alkyl and $C_1$–$C_{12}$alkenyl, $R_1$ is selected from the group consisting of $C_1$–$C_{18}$ alkyl and $C_2$–$C_{18}$ alkenyl, A is alkylene oxide of the formula selected from the group consisting of $$-CH_2CH_2O)_m, -C_3H_6O)n-$$

and combinations thereof; X is a number from 0 to 15 and the numerals for m and n are chosen such that the total content of said alkylene oxide in the molecule amounts to 10 to 800 alkylene oxide units.

2. The water-soluble lubricants of claim 1 characterized by a content of compounds of the formula (1), wherein R is selected from the group consisting of hydrogen and $C_1$–$C_4$ alkyl, $R_1$ is selected from the group consisting of $C_6$–$C_{18}$ alkyl and $C_6$–$C_{18}$ alkenyl, A is a group of the formula $$-CH_2CH_2O)_m,$$

X is a number from 1 to 9 and the numeral for m and n is chosen such that the total content of ethylene oxide in the molecule amounts to 40 to 200 ethylene oxide units.

3. A water-soluble lubricant composition comprising: an oxyalkylated, esterified linear or cyclic novolak of the formula (1)

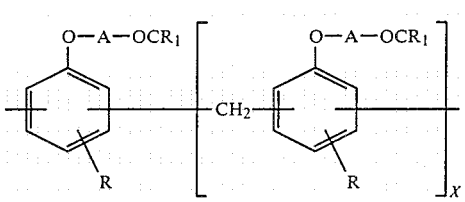

(1)

wherein R is selected from the group consisting of hydrogen, $C_1$–$C_{12}$ alkyl and $C_1$–$C_{12}$ alkenyl, $R_1$ is selected from the group consisting of $C_1$–$C_{18}$ alkyl and $C_2$–$C_{18}$ alkenyl, A is alkylene oxide of the formula selected from the group consisting of $$-CH_2CH_2O)_m, -C_3H_6O)_n-$$

and combinations thereof;

X is a number which is at least 1 but is less than 15 and the numerals for m and n are chosen such that the total content of said alkylene oxide in the molecule amounts to 10 to 800 alkylene oxide units.

4. A water-soluble lubricant composition according to claim 3 wherein X is a number from 1 to 9.

* * * * *